United States Patent [19]

Tahbaz

[11] Patent Number: 4,710,232

[45] Date of Patent: Dec. 1, 1987

[54] PROCESS FOR CLEANING METAL ARTICLES

[76] Inventor: John A. Tahbaz, 5396 Willow La. #E, Murray, Utah 84107

[21] Appl. No.: 616,203

[22] Filed: Jun. 1, 1984

[51] Int. Cl.[4] ..... B08B 3/12

[52] U.S. Cl. ..... 134/1; 134/2; 134/36; 134/40; 252/139; 252/158

[58] Field of Search ..... 134/1, 2, 29, 36, 40; 252/139, 140, 158, 159

[56] References Cited

U.S. PATENT DOCUMENTS

| | | | |
|---|---|---|---|
| 3,210,287 | 10/1965 | Kelly et al. | 252/139 |
| 3,626,559 | 12/1971 | Rossmann et al. | 134/40 |
| 3,709,825 | 1/1973 | Chirash et al. | 134/40 |
| 3,835,070 | 9/1974 | Beck | 134/40 |
| 3,887,497 | 6/1975 | Ulvild | 252/139 |
| 3,960,742 | 6/1976 | Leonard | 252/139 |
| 4,048,121 | 9/1977 | Chang | 252/139 |
| 4,349,448 | 9/1982 | Steele | 134/40 |
| 4,390,465 | 6/1983 | Spekman, Jr. | 134/40 |

FOREIGN PATENT DOCUMENTS

| | | | |
|---|---|---|---|
| 244486 | 11/1960 | Australia | 134/40 |
| 890567 | 3/1962 | United Kingdom | 252/139 |

*Primary Examiner*—Peter Hruskoci

[57] ABSTRACT

An industrial process is disclosed for cleaning undesirable, dirty residue from the surfaces of metal articles. The process comprises mixing an alkaline cleaner and an emulsion cleaner, and intimately contacting the metal articles with the cleaning mixture at ambient temperatures.

12 Claims, No Drawings

PROCESS FOR CLEANING METAL ARTICLES

BACKGROUND OF THE INVENTION

1. Field

The present invention relates to industrial processes for cleaning an undesirable, dirty residue from the surfaces of metal articles, wherein the undesirable, dirty residues which have been left on the metal articles from previous metal working operations, are cleaned from the metal articles at ambient temperature and at an economically feasible cost.

2. State of the Art

The metal working industry uses numerous methods for stamping, cutting, welding, grinding, drawing, machining and polishing the myriad of metal parts and products which are produced. As a result of such metal working operations, an undesirable, dirty residue is left on the surfaces of the metal parts and products. The dirty residue must be removed in most situations before the metal parts or products are employed for their desired use.

In order to achieve this cleaning at an ambient temperature, it has been common to use degreasing compositions such as methyl ethyl ketone, and methylene chloride and other polyhalogenated and aliphatic and aromatic hydrocarbons to remove grease and oil from metal parts. However, these compositions are rather expensive and are pollutants of the environment which are difficult to dispose of. Further, these compositions must be handled with care to avoid costly losses of the compositions. Because of the costly nature of the compositions, elaborate apparatus and processes must be used to reclaim the dirty compositions for reuse. In addition, many of the compositions present particular hazards to anyone who may come in contact with the compositions or harmful vapors thereof. To avoid the costs associated with the degreasing compositions, it has been proposed to utilize a strong aqueous based cleaning composition. Almost universally, aqueous hot alkaline cleaning solutions are used.

To achieve satisfactory cleaning of metal articles which have been subjected to a previous metal working operation, the alkaline cleaning solutions must be heated to a temperature of from about 130° F. to 150° F. The cost of heating the cleaning solutions is significant and greatly ameliorates the advantage which such solutions otherwise have in being initially less expensive than the degreasing compositions mentioned previously. In addition, the handling of hot alkaline solutions create other less tangible problems including increased maintenance and reduced equipment life.

3. Objectives

It is a principal objective of the present invention to provide a novel, unique process for cleaning metal articles which have an undesirable, dirty residue left on the surfaces thereof, wherein a novel, aqueous based cleaning solution is used and the cleaning is accomplished at ambient temperatures of from about 4° C. to 40° C.

A particular objective of the present invention is to provide a process which results in a high, completely acceptable cleaning efficiency even when the process is operated at ambient temperatures as low as 4° C.

A further objective of the present invention is to provide a process for cleaning metal articles using a novel, aqueous based cleaning solution wherein increased equipment life and reduced maintenance is experienced in comparison to conventional cleaning processes utilizing a hot alkaline cleaning composition.

An additional objective of the present invention is to provide novel lubricating compositions and polishing compositions for use in metal treating operations, wherein the dirty residues left on the metal articles are more readily removed during subsequent procedures for cleaning the metal articles.

SUMMARY OF THE INVENTION

The above objectives are achieved in accordance with the present invention by providing an improved process for cleaning metal articles which have an undesirable, dirty residue left on the surfaces thereof as a result of previous metal working operations to which the metal articles have been subjected, such as cutting, welding, grinding, stamping, drawing, machining and polishing. In the operation of the improved process, an alkaline cleaner and an emulsion cleaner are mixed together. The alkaline cleaner comprises an aqueous solution of a soluble salt selected from the group consisting of alkaline carbonates, alkaline phosphates, alkaline silicates, alkaline sulfates, alkaline borates, caustic soda, caustic potash and mixtures thereof. The emulsion cleaner comprises water, an organic solvent and a surfactant. The organic solvent component of the emulsion cleaner consists essentially of one or more organic compounds selected from the group consisting of hydrocarbons, ketones, aldehydes, alcohols glycol ethers and glycols, wherein the organic compounds in that group are further limited to those compounds containing from 4 to 16 carbon atoms. The surfactant component of the emulsion cleaner is anionic, nonionic, cationic or amorphic, with the surfactants being preferably selected from the group consisting of sulfated hydrocarbons, sulfonated hydrocarbons, ethoxylated hydrocarbons, ethoxylated alcohols, saponified fatty acids, polymerized fatty acids, quarternary ammonium compounds, amines, amide condensates and mixtures thereof.

The surfaces of the metal articles are intimately contacted with the mixture of alkaline cleaner and emulsion cleaner at a temperature within the range of about 4° C. to about 40° C. for a time sufficient to clean the dirty residues from the surfaces of the metal articles. Following the contact with the cleaning solution, the metal articles are preferably rinsed with water.

Additional objects, features and advantages of the present invention will become apparent from the following detailed description of the preferred embodiments of the invention.

DETAILED DESCRIPTION OF THE PREFERRED EMBODIMENTS

In accordance with the present invention, an improved process is provided for cleaning metal articles which have an undesirable, dirty residue left on the surfaces thereof. The dirty residues are generally left on the metal articles as a result of previous metal working operations to which the metal articles have been subjected. Such previous metal working operations include cutting, welding, grinding, stamping, drawing, machining and polishing. The dirty residues left on the metal articles comprise various lubricants, grinding and cutting aids, fluxes and polishes which are applied to the metal articles in the previous metal working operations. It is, of course, necessary to remove the dirty residues from the metal articles. As mentioned previously, heretofore the process which has been used to clean the metal articles has involved the use of a hot alkaline cleaning solution.

The process of the present invention produces cleaning results which are equally as efficient or even superior to the prior art processes. Most unexpectedly, the process of the present invention can be operated at room temperature as compared to the elevated temperatures of between about 130° F. and 150° F. as required by the processes of the prior art. The elimination of the need to maintain the cleaning solution at an elevated temperature greatly reduces the direct cost involved by totally eliminating the cost of heating the cleaning solutions as has heretofore been required to achieve acceptable cleaning of the metal articles. The direct costs in the industrial cleaning of metal articles can be reduced by as much as 35% or more by using the process of the present invention. What's more, the process of the present invention utilizes the same apparatus and equipment as the prior art processes. Thus, no new expenditure of capital is required to achieve the sizeable benefits of the present invention. Then even further, other intangible benefits are achieved with the process of the present invention. For example, greatly reduced maintenance and significantly increased equipment life are achieved as a result of the lower temperature operation of the present invention.

The process of the present invention comprises mixing an alkaline cleaner and an emulsion cleaner together to make an aqueous cleaning solution. The surfaces of the metal articles which are to be cleaned are then intimately contacted with the aqueous cleaning solution at a temperature within the range of about 4° C. and 40° C. for a time sufficient to clean the dirty residues from the surfaces of the metal articles. Preferably, the metal articles are rinsed in water following the cleaning contact with aqueous cleaning solution.

The alkaline cleaner component of the aqueous cleaning solution comprises a soluble salt selected from the group consisting of alkaline carbonates, alkaline phosphates, alkaline silicates, alkaline sulfates, alkaline borates, caustic soda, caustic potash and mixtures thereof. The emulsion cleaner component of the aqueous cleaning solution comprises water, an organic solvent and a surfactant, with the organic solvent consisting essentially of one or more organic compounds which contain from 4 to 16 carbon atoms and which are further selected from the group consisting of aliphatic and aromatic hydrocarbons, ketones, aldehydes, alcohols, glycols and glycol ethers.

The organic solvent of the emulsion cleaner component can be an aliphatic hydrocarbon, an aromatic hydrocarbon or mixtures thereof. For example, the organic solvent can be any of the compositions selected from the group consisting of kerosene, stoddard solvent, petroleum distillates, as well as aliphatic and cyclic alkanes, aliphatic and cyclic alkenes. Aromatic compounds which can be utilized as the organic solvent of the emulsion cleaner component include benzene and benzene substituted with an aliphatic side chain. As mentioned previously, the organic solvent can also be a ketone, an aldehyde or an alcohol. Examples of ketones include acetone, methyl ethyl ketone, methyl n-propyl ketone, ethyl ketone, methyl isopropyl ketone, methyl n-butyl ketone, ethyl n-propyl ketone, ethyl isopropyl ketone, methyl isobutyl ketone and butyl ketone. Examples of aldehydes include propanal, butanal, n-ethyl propanal, n-pentanal, isopentanal, 2-methyl butanal and benzaldehyde. Examples of alcohols include methyl alcohol, ethyl alcohol, n-propyl alcohol, isopropyl alcohol, n-butyl alcohol, isobutyl alcohol, sec-butyl alcohol, tert-butyl alcohol, n-pentyl alcohol, n-hexyl alcohol, n-heptyl alcohol, n-octyl alcohol, n-decyl alcohol, n-dodecyl alcohol, ethylene glycol, ethylene propylene glycol, polyethylene glycol, ethylene glycol monobutyl ether, ethylene glycol monomethyl ether, ethylene glycol dimethyl ether, ethylene glycol monoethyl ether, ethyylene glycol diethyl ether, ethylene glycol dibutyl ether, ethylene glycol monopropyl ether and ethylene glycol dipropyl ether.

The surfactant component of the emulsion cleaner is selected from the group consisting of sulfated hydrocarbons, sulfonated hydrocarbons, ethoxylated hydrocarbons, ethoxylated alcohols, saponified fatty acids, polymerized fatty acids, esters, quaternary ammonium compounds, amines, amide condensates and mixtures thereof. In a preferred embodiment, the surfactant is selected from the group consisting of ethoxylated alcohols, sulfonated hydrocarbons and mixtures thereof.

As mentioned above, the alkaline cleaner comprises a soluble alkaline salt. Examples of such alkaline cleaners include sodium carbonate, potassium carbonate, sodium phosphate, potassium phosphate, trisodium phosphate, sodium tripolyphosphate, tetrasodium phosphate, tetrapotassium pyrophosphate, tetrasodium pyrophosphate, sodium silicate, sodium metasilicate pentahydrate, sodium sulfate, potassium sulfate, sodium borate and potassium borate. Mixtures of two or more of the alkaline salts can be used.

The alkaline salts are commonly obtained in the dry, powdered state. The emulsion cleaner is generally obtained as a concentrate containing from 1% to 30% water, 1% to 10% surfactants and the remainder being the organic solvent. The alkaline cleaner and the emulsion cleaner are mixed together with water to form the cleaning solution of the present invention. The resulting cleaning solution preferably contains from about 1 to 6 ounces of the alkaline cleaner component per gallon of water in the cleaning solution and from about 1 to 6 ounces of the emulsion cleaner component per gallon of water in the cleaning solution. Preferably, the alkaline cleaner component and the emulsion cleaner component are used in generally equal concentrations in the cleaning solution.

The surfaces of the metal articles which are to be cleaned are intimately contacted with the cleaning solution, with the cleaning solution being at room temperature. In winter conditions the temperature of the cleaning solution may drop as low as about 4° C., and during summer operations, the temperature of the cleaning solution may go as high as 40° C. Contact of the surfaces of the metal articles with the cleaning solution can be achieved in several well known operations. The metal articles can be sprayed with the cleaning solution, or the metal articles can be dipped into the cleaning solution. In the latter operation, the cleaning solution in the dip container is subjected to mechanical agitation, air agitation or ultra sonic agitation simultaneously with the metal articles being dipped in the cleaning solution.

When the metal articles which are to be cleaned have come from previous operations comprising cutting, welding, grinding, stamping, drawing and machining, and further when a lubricant is used during such previous operations, it has been found most advantageous to use, as the lubricant in the previous metal treating operation, an oil selected from the group consisting of paraffinic oils, napthyenic oils and mixtures thereof to which a detergent additive has been added. The detergent additive is preferably selected from the group consisting of petroleum sulfonates, fatty acid soaps, ethyoxylated alcohols, petroleum sulfonates, polyglycols and mixtures thereof. The use of the particular lubricants mentioned above during the previous metal treating operation, results in maximizing the efficiency of the cleaning of the metal articles in accordance with the present invention.

Similarly, when the metal articles which are to be cleaned have come from previous polishing operations in which a polishing composition is used during such previous operations, it has been found most advantageous to use a novel polishing composition in the previous polishing treatment. The novel polishing composition comprises an oil selected from the group consisting of aromatic hydrocarbons, aliphatic hydrocarbons, napthenic oils, paraffinic oils, silicones, stearates, natural fats, glycol ethers and polyglycols. An anionic or nonionic surfactant is added to the oil along with an abrasive. The surfactant is preferably selected from the group consisting of fatty acid soaps, ethoxylated alcohols, petroleum sulfonates, polyglycols and mixtures thereof. The abrasive is selected from the group consisting of aluminum oxides, carborundums, borates, clays, silicon dioxides, diatomaceous earths and mixtures thereof.

In a series of tests conducted at a commercial facility in which stainless steel items such as kitchen sinks were being produced to obtain adequate cleaning following stamping and grinding operations, the commercial facility had been utilizing a heated caustic cleaning solution. The caustic cleaning solution was heated to a temperature of between about 130° F. and 150° F., and the metal articles were cleaned by spraying the cleaning solution on the metal articles.

Neither the spraying apparatus, nor any of the physical apparatus which was used at the commercial facility was modified during the experimental tests. The tests consisted of essentially substituting cleaning solutions of the present invention in place of the prior art caustic cleaning solutions. The cleaning solutions of the present inventon were made by mixing an alkaline cleaner and an emulsion cleaner together with water. The concentration of alkaline cleaner was between 1 and 6 ounces per gallon of the resulting cleaning solution. The concentration of the emulsion cleaner was also between 1 and 6 ounces per gallon of the resulting cleaning solution.

The compositions of the alkaline cleaner and emulsion cleaner components for three of the tests which were made are given in the following Tables 1 and 2. Percentages are by weight.

TABLE I

| Composition of Alkaline Cleaner Component | Test 1 | Test 2 | Test 3 |
|---|---|---|---|
| NaOH | 38% | 38% | 48% |
| Sodium Tripolyphosphate | 10% | 30% | 10% |
| Sodium Metasilicate | 10% | 10% | — |
| Sodium Carbonate | 20% | 20% | 30% |
| Sodium Lignin Sulfate | 1% | — | — |
| Trisodium Phosphate | 20% | — | 10% |
| Triton X-100* | 0.5% | — | — |
| Triton X-45* | 0.5% | — | — |
| Sodium Linear Alkyl Sulfonate | — | 2% | 2% |

TABLE I-continued

*Trademarks for ethoxylated alcohols marketed by Rohm & Haas.

TABLE II

| Composition of Emulsion Cleaner Component | Test 1 | Test 2 | Test 3 |
|---|---|---|---|
| Dodecyl Benzene | — | 20% | — |
| Deoderized Kerosene | 45% | 20% | — |
| Stoddard Solvent | — | — | 40% |
| Aromatic Naphtha | 20.5 | 20.5% | 20.5% |
| Tall Oil | — | 5% | 5% |
| Linear Alkyl Sulfonic Acid | 10% | 10% | 10% |
| NaOH | 2.5% | 2.5% | 2.5% |
| Isopropyl Alcohol | — | 5% | — |
| Hexalene Glycol | 5% | — | 5% |
| Ethylene Glycol Monobutyl Ether | 5% | 5% | 5% |
| Monoethanolamine | 2% | 2% | 2% |
| Triton X-100* | 5% | 5% | 5% |
| Water | 5% | 5% | 5% |

*Trademark for ethoxylated alcohols marketed by Rohm & Haas.

The alkaline cleaner component was in the form of a dry powdered material, and was added to water to make a solution containing from 1 to 6 ounces of the alkaline cleaner per gallon of the solution. The emulsion cleaner was in the form of a concentrated liquid, and was added to the aqueous alkaline cleaner solution in an amount of between 1 and 6 ounces per gallon of the aqueous solution.

The cleaning solutions containing the alkaline cleaner component and the emulsion cleaner component were used to clean metal articles by spraying the solution at room temperature on the metal articles. The spraying apparatus at the commercial facility was used to spray the metal articles, i.e., stainless steel sinks, as the metal articles were being produced in the otherwise normal operation of the commercial facility.

The cleaning efficiency of the test solutions were equal to or better than the conventional, prior art solutions customarily used at the commercial facility. Because the test solutions required no heating as is required with the prior art solutions, it was found that a savings of about 35% could be realized in the cleaning operation by using the test solutions in place of the conventional, prior art cleaning solutions. In addition, there were significant, nontangible benefits which were observed. The nontangible benefits included reduced maintenance on the apparatus used in the cleaning process and an expected increase in equipment life as a result of the use of the room temperature solutions.

In a separate series of tests, it was found that the cleaning efficiency of the process of the present invention could be improved by incorporating improved grinding oil additives in any previous metal treating steps in which a grinding oil is used. Three examples of such improved grinding oil additives are given in Table 3. Percentages are by weight.

TABLE III

| Grinding Oil Additive | Example 1 | Example 2 | Example 3 |
|---|---|---|---|
| Triton X-45* | 40% | 30% | 10% |
| Triton X-100* | 20% | 15% | 17% |
| Petroleum Sulfonate | — | 10% | 20% |
| Stoddard Solvent | 20% | — | 20% |

TABLE III-continued

| | Grinding Oil Additive | | |
|---|---|---|---|
| | Example 1 | Example 2 | Example 3 |
| Liquid Paraffin | 20% | 20% | 20% |
| Tall Oil | — | 20% | 10% |
| Monoethanolamine | — | 5% | 3% |

*Trademarks for ethoxylated alcohols marketed by Rohm & Haas. The grinding oil additives were added to the grinding oils in an amount of between about 1% and 10% by weight of the grinding oil.

Similarly, in another series of tests, it was found that the cleaning efficiency of the present invention could be improved in those instances wherein a previous metal treating step involved polishing of the metal articles with a polishing compound, by using a novel, improved, water soluble polishing composition during the polishing step. Three examples of the improved, water soluble polishing compositions are given in Table 4. Percentages are given by weight.

TABLE IV

| | Improved Polish Composition | | |
|---|---|---|---|
| | Example 1 | Example 2 | Example 3 |
| Polyglycol 6000 | 0.5% | — | — |
| Water | 54.5% | 65.5% | 61% |
| Carboxymethylcellulose 4000 | — | 0.5% | — |
| Bentonite | 20% | 20% | — |
| Stearic Acid | 5% | — | — |
| Liquid Paraffin | — | — | 5% |
| Tall Oil | 15% | 5% | 5% |
| Monoethanolamine | 5% | 5% | 5% |
| Coco Amide Condensate | — | 2% | 2% |
| Triton X-100* | — | 2% | 2% |
| Aluminum Oxide | — | — | 20% |

*Trademarks for ethoxylated alcohols marketed by Rohm & Haas.

Although particularly preferred embodiments of the invention have been described, it is to be understood that the present disclosure is made by way of example and that various other embodiments are possible without departing from the subject matter coming within the scope of the following claims, which subject matter is regarded as the invention.

I claim:

1. A process for cleaning metal articles which have an undesirable, dirty residue left on the surfaces thereof resulting from previous metal working operations to which the metal articles have been subjected, said process comprising the steps of mixing an alkaline cleaner and an emulsion cleaner with water to form a cleaning solution mixture, wherein said alkaline cleaner comprises a soluble salt selected from the group consisting of alkaline carbonats, alkaline silicates, alkaline phosphates, alkaline sulfates, alkaline borates, caustic soda, caustic potash and mixtures thereof, and said emulsion cleaner comprises about 1 to 30% water, about 1 to 10% surfactant, and the remainder being an organic solvent consisting essentially of one or more organic compounds selected from the group consisting of aliphatic hydrocarbons, aromatic hydrocarbons, ketones, aldehydes, alcohols, glycols, glycol ethers, and mixtures thereof wherein the organic compounds in said group are further limited to those containing from 4 to 16 carbon atoms, and with the surfactant being anionic, nonionic, cationic or amorphic and selected from the group consisting essentially of sulfated hydrocarbons, sulfonated hydrocarbons, ethoxylated hydrocarbons, ethoxylated alcohols, saponified fatty acids, polymerized fatty acids, quaternary ammonium compounds, amines, amide condensates and mixtures thereof, said cleaning solution mixture containing from about 1 to 6 ounces of said alkaline cleaner and from about 1 to 6 ounces of emulsion cleaner per gallon of water in the mixture, and imtimately contacting the surfaces of the metal articles with the mixture of alkaline cleaner and emulsion cleaner at a temperature within the range of about 4° C. and 40° C. and for a time sufficient to clean the dirty residues from the surfaces of the metal articles.

2. A process in accordance with claim 1, wherein the organic solvent is selected from the group consisting of kerosene, stoddard solvent, petroleum distillates, aliphatic alkanes, cyclic alkanes, aliphatic alkenes, cyclic alkenes, benzene, benzene substituted with an aliphatic side chain, acetone, methyl ethyl ketone, methyl n-propyl ketone, ethyl ketone, methyl isopropyl ketone, methyl n-butyl ketone, ethyl n-propyl ketone, ethyl isopropyl ketone, methyl isobutyl ketone, butyl ketone, propanal, butanal, methyl propanal, n-pentanal, isopentanal, 2-methyl butanal, benzaldehyde, methyl alcohol, ethyl alcohol, n-propyl alcohol, isopropyl alcohol, n-butyl alcohol, isobutyl alcohol, sec-butyl alcohol, tert-butyl alcohol, n-pentyl alcohol, n-hexyl alcohol, n-heptyl alcohol, n-octyl alcohol, n-decyl alcohol, n-dodecyl alcohol, ethylene glycol, ethylene propylene glycol, polyethylene glycol, ethylene glycol monomethyl ether, ethylene glycol dimethyl ether, ethylene glycol moroethyl ether, ethylene glycol diethyl ether, ethylene glycol monobutyl ether, ethylene glycol dibutyl ether, ethylene glycol monopropyl ether, ethylene glycol dipropyl ether and mixtures thereof.

3. A process in accordance with claim 1, wherein the surfactant is selected from the group consisting of ethoxylated alcohols, sulfonated hydrocarbons and mixtures thereof.

4. A process in accordance with claim 1, wherein the metal articles are rinsed in water following the cleaning contact with the mixture of alkaline cleaner and emulsion cleaner.

5. A process in accordance with claim 1, wherein the metal articles are dipped into the mixture of alkaline cleaner and emulsion cleaner during the contact step and the mixture of alkaline cleaner and emulsion cleaner is simultaneously subjected to mechanical agitation, air agitation or ultra sonic agitation.

6. A process in accordance with claim 1, wherein the metal articles are sprayed with the mixture of alkaline cleaner and emulsion cleaner during the contacting step.

7. A process in accordance with claim 1, wherein the previous metal working operations comprise cutting, welding, grinding, stamping, drawing, and machining, and further wherein the lubricant used during such metal working operations comprises an oil selected from the group consisting of paraffinic oils, napthenic oils and mixtures thereof; and a detergent additive.

8. A process in accordance with claim 7, wherein the detergent additive in the lubricant is selected from the group consisting of petroleum sulfonates, fatty acid soaps, ethoxylated alcohol, polyglycols and mixtures thereof.

9. A process in accordance with claim 1, wherein the previous metal working operations comprise polishing, and further wherein the polishing composition used during such metal working operations comprises an oil selected from the group consisting of hydrocarbons, aromatic, and aliphatic hydrocarbons, napthenic oils, silicones, stearates, natural fats, glycol ethers and polyglycols;

an anionic or nonionic surfactant; and an abrasive.

10. A process in accordance with claim 9, wherein the surfactant in the polish is selected from the group consisting of fatty acid soaps, ethoxylated alcohol, petroleum sulfonates, polyglycols and mixtures thereof.

11. A process in accordance with claim 10, wherein the abrasive is selected from the group consisting of aluminum oxides, carborundums, borates, clays, silicon dioxides, diatomaceous earths and mixtures thereof.

12. A process in accordance with claim 9, wherein the abrasive is selected from the group consisting of aluminum oxides, carborundums, borates, clays, silicon dioxides, diatomaceous earths and mixtures, thereof.

* * * * *